United States Patent [19]

Lan

[11] Patent Number: 4,941,635

[45] Date of Patent: Jul. 17, 1990

[54] CUP-HOLDER STABILIZER

[76] Inventor: Yung-Huei Lan, 3F No. 32 Lane 61 Sec.2 Hang-Chuo S.Rd., Taipei, Taiwan

[21] Appl. No.: 191,899

[22] Filed: May 10, 1988

Related U.S. Application Data

[63] Continuation-in-part of Ser. No. 818,368, Jan. 13, 1986, Pat. No. 4,760,987.

[51] Int. Cl.[5] ..... A45D 42/14; F16B 47/00

[52] U.S. Cl. ..... 248/346.1; 248/362; 248/205.9; 248/311.2

[58] Field of Search ..... 248/346.1, 362, 154, 248/205.9, 206.2, 311.2, 363

[56] References Cited

U.S. PATENT DOCUMENTS

| | | | |
|---|---|---|---|
| 2,009,721 | 7/1935 | Williams | 248/362 X |
| 2,839,260 | 6/1958 | Jacobi, Jr. | 248/362 X |
| 2,932,119 | 4/1960 | Borah | 248/346.1 |
| 2,936,139 | 5/1960 | Lindstrom | 248/362 X |
| 3,013,688 | 12/1961 | Luning | 248/362 X |
| 3,747,170 | 7/1973 | Kieves | 248/362 |
| 4,040,549 | 8/1977 | Sadler | 248/311.2 X |
| 4,596,370 | 6/1986 | Adkins | 248/311.2 |
| 4,756,497 | 7/1988 | Lan | 248/346.1 X |

FOREIGN PATENT DOCUMENTS

| | | | |
|---|---|---|---|
| 2605914 | 8/1977 | Fed. Rep. of Germany | 248/362 |

*Primary Examiner*—Randolph A. Reese
*Assistant Examiner*—Peter M. Cuomo

[57] ABSTRACT

A cup-holder stabilizer comprises of an extensible and contractible cylinder unit. An inner space of an upper cylinder of the cylinder unit receives a cup or other item. The upper cylinder is provided with multi-layered skirt-shaped pieces which can be used to cover the outside surface of the upper cylinder, or they can be inverted into the inner space of the upper cylinder to be used as paddings to secure a cup or other item of a smaller diametrical size. The lower end of a lower cylinder of the cylinder unit is provided with a cupule, the cupule is provided with central vent hole which can be sealed by the plug located in the upper cylinder; when the cup-holder stabilizer is placed on a table surface, gravity will cause the cylinder unit to contract and the plug located in the upper cylinder will come down to seal up the central vent bore of the cupule, thus the cupule becomes firmly held. When the cup-holder stabilizer is lifted the cylinder unit will extend and cause the plug to unseat from the vent bore of the cupule.

2 Claims, 2 Drawing Sheets

CUP-HOLDER STABILIZER

BACKGROUND OF THE INVENTION

The present invention is the continuation in part to the original application case 06/818,368, now U.S. Pat. No. 4,760,987 in which, the intermediate portion of the cupule is formed by the base plate 22 of the lower cylinder which is made of more rigidity material; the interconnection between the cupule and the lower cylinder is stronger than the original case; both of the manufacturing accuracy and the height of the two-fold upper cylinder can be reduced as compared to the inner cylinder is the original case; further more, the multi-layered padding of the present invention can be used to adjust the inner diameter of the upper cylinder for the adaptation of a cup or other objective item to be supported having various outside diameter. All of these said features are superior than the original case.

SUMMARY OF THE INVENTION

The present invention is to provide a cup-holder stabilizer, which includes a two-fold upper cylinder and a lower cylinder which is located inbetween the inner-fold and the out-fold of the upper cylinder; the upper cylinder by incorporating with the lower cylinder forms an extendable means; the outer edge of the base plated of the lower cylinder in fitted with a ring-shaped rubber thereon and forms a cupule together with the under side of the base plate; the central portion of the cupule is provided with a bore; a movable plug which moves together with the upper cylinder, is used to seal the bore on the central portion of the cupule, when the upper cylinder is moved upwardly a certain distance, the plug will be opened to let the air going into the cupule for easy lifting of the cup-holder stabilizer; the inner space of the upper cylinder is used for the adaptation of a cup, around the outer surface of the upper cylinder it is provided with multi-layered skirt-shaped paddings, they can be inverted into the inner space of the upper cylinder to reduce the inside diameter therein for the adaptation of a cup or an objective item to be supported with a smaller outside diameter.

DETAILED DESCRIPTION

Figure 1:
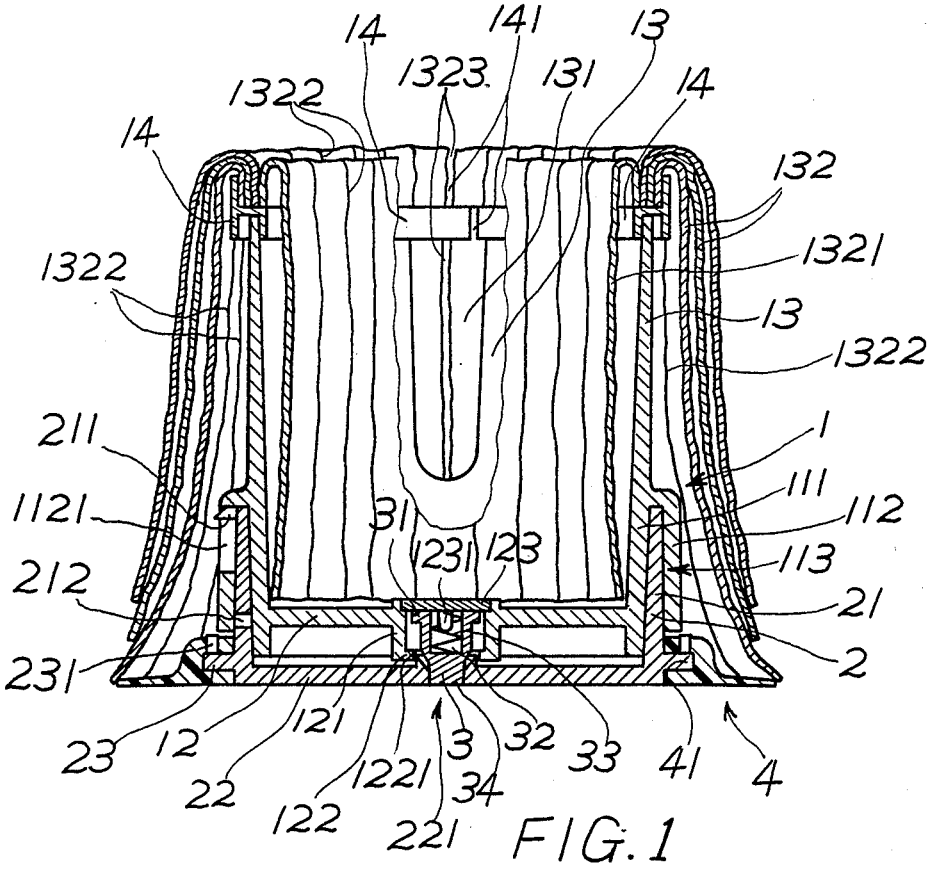
FIG. 1 is the sectional view of the present invention, illustrating it is placed on a feat surface with its extendable cylinder stays in contracted position, sealing plug seals the bore of the cupule to maintain the cup-holder stabilizer firmly seated on the feat surface by vacuum force.
Figure 2:
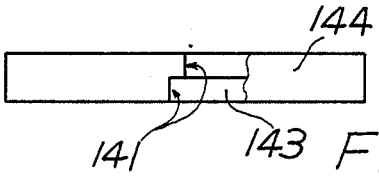
FIG. 2 is the side view of the ring-shaped adaptor without padding attached, a small portion starting from right side of seam 141 is shown in partial sectional view for illustrating the seam in detail.
Figure 3:
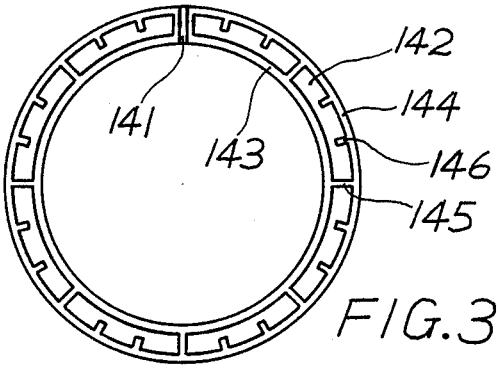
FIG. 3 is the bottom side view of the item shown in FIG. 3.

The main component of the present invention is an extendable cylinder unit which comprises of an upper cylinder 1 and a lower cylinder 2, the upper cylinder is provided with a two-fold walls, inbetween its inner-fold wall 111 and the outer-fold wall 11 it is provided with a ring-shaped hollow space 113 for the adaptation of the side wall 21 of the lower cylinder; the side wall 21 of the lower cylinder is provided with a protruding block 211 for engaging into the elongated slot 1121 on the outer-fold wall 112 of the upper cylinder so that it can be slid up and down along this elongated slot 1121, since the movement of this protruding block 211 is limited within this elongated slot 1121, therefore, the extending distance of the cylinder unit is limited therein without breaking off due to over extension; the lower part on the side wall of the lower cylinder is provided with a orifice 212 for the communication of air exited both inside and outside of the cylinder so as to prevent the extending and contracting movement of the cylinder unit to be jammed by air pressure difference; the central portion on the base plate 12 of the upper cylinder is provided with a bore 121; the central portion on the protruded part 122 of the base plate 12 is also provided with a bore 1221 for passing through the lower part of a plug 3 while stopping the flange 31 on upper portion of the same plug 3 from passing through; the top end of the protruded part 121 on base plate 12 of the upper cylinder is provided with a cover plate 123, the central portion on upper part of the plug is provided with a dent for receiving a coiled spring 33, and the top end of this spring 33 is seated against and telescoped on respectively the under side surface and the boss 1231 of the cover plate; the plug head 34 can be inserted into the central bore 221 on base plate 22 of the lower cylinder for air tight sealing; the base plate of the lower cylinder is provided with a circular flange 23 for the attachment of the cupule 4 via its ring-shaped portion 41 to maintain air tightness; the top side surface of this circular flange 23 is provided with plurality of small bosses 231 which engage into the plurality of small bores on top-fold of the ring-shaped portion 41 of the cupule 4 for firm interconnection.

The inner space of the upper cylinder is used for the adaptation of a cup or other item to be supported; the upper end of the upper cylinder is connected with a thin cylinder 13 having plurality of grooves 131 (only one of them is shown in FIG. 1) for furnishing some diametrical expansion to the same thin cylinder 13, when a cup with a handle is inserted into it, the handle can be slid into one of these grooves; around the top end of this thin cylinder 13 it is provided with multi-layered skirt 132, this skirt 132 can be wrapped around the outer surface of the present invention, or it can be inverted into the inner space of the present invention as skirt 1321 as shown in FIG. 1; when a layer of the skirt is inverted into the inner space of the upper cylinder, it will be used as a padding for holding tight of a cup with smaller diameter, therefore, the number of skirt layer required to be inverted into the inner space of the upper cylinder depends upon diametrical size of the cup to be held; besides, the inner space of the upper cylinder is shaped into a proper inverted conical form for the adaptation of a cup with various diametrical size; the skirt can be furnished with plurality of pleats 1322 (as a pleated skirt) for providing flexibility to be easily inverted in or out as well as for uniform distribution and beautification; the skirt 132 can be changed into a net form, a strip form, a surroundingly distributed tubular form, or properly intermingling of these said forms for beautification as well as better adjustment to the diametrical size of a cup; a longitudinal slit 1323 is provide on groove 131 of the skirt 132, which closes near the lower portion of the same skirt, so that after handle of a cup is inserted along this slit 1323, the skirt still can maintain its perfect covering function; the length for each layer of the skirt can be varied for the accommodation of beautification; furthermore, the skirt can also serve heat insulation purpose to prevent heat dissipation as well as to prevent fingers from burnt after the cup is filled with hot water; the skirt can be adhered either on the inner side or the outer side at the top end of the thin cylinder 13; or it can be adhered on the adapter 14, then fits the adapter 14 on the top end of the thin cylinder 13; the adapter is a soft material made ring-shaped piece having a seam 141, the seam 141 is divided into two sections so as to make the ring-shaped piece expansible and contractible as well as the handle of a cup can be inserted thereinto; the ring-shaped space 142 of the adapter is used for the inserting in the upper end of the thin cylinder 13, inbetween the inner wall 143 and the outer wall 144 of the ring-shaped space 142, it is provided with plurality of bridging plates 145 for strength enhancement, in the corresponding location on upper end of the thin cylinder 13, it is provided with a opening (not shown in FIG. 1) for preventing blockage during insertion; the strip-shaped protrusion 146 is used to clamp the upper end of the thin cylinder 13 firmly (the thin cylinder is clamped inbetween the protrusion 145 and the inner wall 143); due to the provision of the adapter, the skirt can be easily dismantled for cleaning or replacement.

Figure 4:
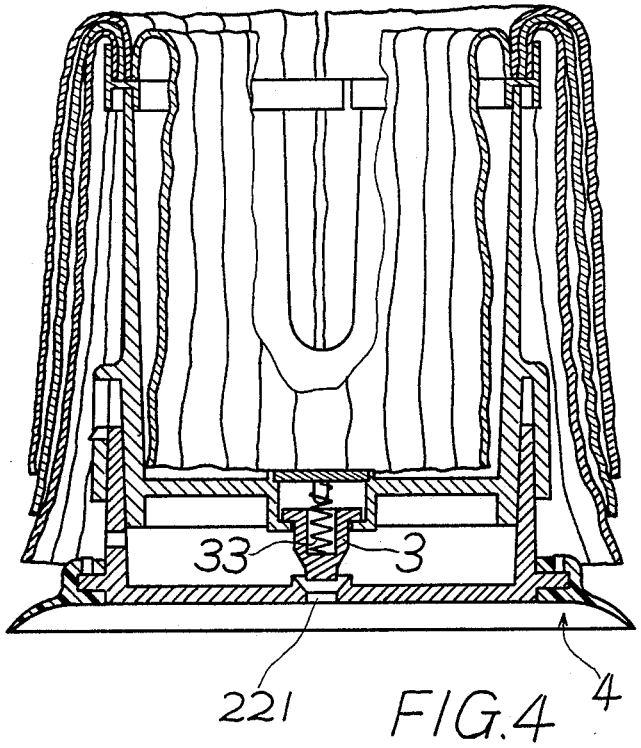
FIG. 4 is the sectional view of the completely assembled cup-holder stabilizer of the present invention, illustrating it is lifted up, the extendable cylinder is extended upwardly, and the sealing plug is pulled up while air flows into the cupule via the vent bore of the cupule.

When the present invention is to be used, the first thing to do is to invert proper amount of skirt layer 132 into the inner space of the thin cylinder, then, insert a cup or other item to be supported into the inner space of the thin cylinder and the upper cylinder assembly, finally place it on a table surface and press it downwardly to expel the air trapped inside the cupule, to make the lower cylinder to be retracted into the upper cylinder, and to make the plug to be inserted into the bore 221, at this time the cupule will suck firmly at the table surface and any impact will not be able to overturn the cup; when the cup or the item to be supported is being lifted up, the upper cylinder will go upwardly together with the cup o the item to be supported (as shown in FIG. 4), in the beginning, the spring 33 still exerts its downward pushing force on the plug to seal the bore 221 for the maintaining of the cupule sucking firmly on the table surface, when the cylinder unit goes upwardly a certain distance, the upper surface of the base plate 122 will become in touching with the flange 31 of the plug and consequently lifting the plug up, at this time, bore 221 is opened and air goes into the cupule thus the sucking action is relieved therefrom, then, the cup together with the cup holder stabilizer can be lifted easily from the table surface.

I claim:

1. A cup-holder stabilizer for holding a cup and the like on a flat surface, comprising:

an upper holder portion, having an outside surface and including an upper cylinder which has an upper portion and a lower portion, said upper portion of said upper cylinder having an upper end, said lower portion of said upper cylinder including an outer fold wall and an inner fold wall connected together at respective upper ends thereof, said outer and inner fold walls having respective portions other than said connected upper ends thereof separated by a first distance so as to define a ring-shaped space between said other portions of said outer and inner fold walls, said inner fold walls defining therein a first inner cylindrical space which is adapted for reception of said cup and the like to be held, said inner fold wall being provided at a lower end thereof with a first base plate which has on a central portion thereof a small cylinder projecting downwardly from said central portion of said first base plate, said small cylinder having a second inner space, said outer fold wall being provided with an elongated slot having a longitudinal length in the height direction of said outer fold wall;

a plug having a lower portion and a top end and configured to be adapted to be received in said second inner space of said small cylinder, said small cylinder having a lower end which is provided with a second base plate having in a central portion thereof a first small bore of such an inner diameter as to allow said lower portion of said pug to pass therehtrough, said top end of said plug being provided with a flange having an outside diameter larger than said inner diameter of said first small bore so as to prevent said plug from dropping out via said first small bore, said small cylinder having an upper end which is provided with a cover plate, said top end of said plug having in a top surface thereof a dent which has a bottom surface and is configured to be adapted to receive a coil spring having an upper end and a lower end, said upper end of said coil spring being rested against said cover plate while said lower end of said spring is arranged to urge against said bottom surface of said dent to push said plug downward;

a lower cylinder, which is configured to be allowed to fit into and to slide along said ring-shaped space between said outer and inner fold walls, said lower cylinder having an outside surface which is provided in a top end portion thereof with a protrusion configured and arranged to fit into said elongated slot of said outer fold wall of said upper cylinder so that, when said upper cylinder is moved in one of an upward and downward directions with respect to said lower cylinder, said protrusion may slide along said elongated slot in the other one of said upward and downward directions with the travel distance of said protrusion being limited within said longitudinal length of said elongated slot, said lower cylinder having a lower end which is provided with a third base plate having a second small central bore configured and arranged so that is may be sealed by said lower portion of said plug, said lower end of said lower cylinder being provided peripherally with an outer circular flange;

a skirt-shaped piece configured and arranged to be fitted around said outer circular flange at said lower end of said lower cylinder so as to form together with said third base plate a cupule adapted to suctorially attach to the flat surface; and a thin cylinder connected to said upper end of said upper portion of said upper cylinder and provided with a separable adapter having multi-layered skirt-shaped soft pads which may be moved between a first position, in which they are outside said upper holder portion, and a second position, in which they are in said first inner cylindrical space, said pads being formed and arranged to be used to cover said outside surface of said upper holder portion when they are moved to said first position and to be used to serve for padding purpose when they are moved to said second position, said pads being formed in one of the forms of a net form, a strip form, a surrounding arranged tubular form and a combination thereof;

whereby, when said upper and lower cylinders are driven to move toward each other by reception of said cup in said first inner cylindrical space and deposition of said cup-holder stabilizer on the flat surface, said lower portion of said plug will be brought to seal up said second small central bore in said third base plate so as to allow said cupule formed together by said third base plate and said skirt-shaped piece to suctorially attach to the flat surface; when said upper and lower cylinders are driven to move apart from each other by lift of said upper cylinder from the flat surface, said second base plate will be brought in touch with said flange of said plug and then pull said plug up so that said second small central bore of said third base plate is opened to disable the suctorial attachment effect of said cupule to the flat surface so as to allow said cup-holder stabilizer to be lifted up.

2. A cup-holder stabilizer as claimed in claim 1, wherein said cup has a handle, and wherein said adapter, said thin cylinder and said pads are provided with slits for receiving said handle of said cup when said cup is received in said first inner cylindrical space.

* * * * *